US007985110B2

(12) United States Patent
Ingebrigtsen et al.

(10) Patent No.: US 7,985,110 B2
(45) Date of Patent: Jul. 26, 2011

(54) CONNECTION SYSTEM AND METHOD FOR CONNECTING AND DISCONNECTING A FLOATING UNIT TO AND FROM A BUOY WHICH IS CONNECTED TO A SUBSEA INSTALLATION

(75) Inventors: Atle Ingebrigtsen, Paradis (NO); Lars Seim, Espeland (NO); Jostein Erstad, Ask (NO)

(73) Assignee: Framo Engineering AS, Bergen (NO)

( * ) Notice: Subject to any disclaimer, the term of this patent is extended or adjusted under 35 U.S.C. 154(b) by 0 days.

(21) Appl. No.: 12/293,529

(22) PCT Filed: Mar. 23, 2007

(86) PCT No.: PCT/NO2007/000115

§ 371 (c)(1),
(2), (4) Date: Jan. 21, 2009

(87) PCT Pub. No.: WO2007/108705

PCT Pub. Date: Sep. 27, 2007

(65) Prior Publication Data

US 2009/0233503 A1 Sep. 17, 2009

(30) Foreign Application Priority Data

Mar. 23, 2006 (NO) ..... 20061335

(51) Int. Cl.
*B63B 22/02* (2006.01)

(52) U.S. Cl. ..... 441/5; 114/230.12

(58) Field of Classification Search ..... 114/230.1, 114/230.12, 230.13, 230.15, 293; 441/3, 441/4, 5

See application file for complete search history.

(56) References Cited

U.S. PATENT DOCUMENTS

| | | | | |
|---|---|---|---|---|
| 5,363,789 | A | 11/1994 | Laurie et al. | |
| 5,540,607 | A * | 7/1996 | Breivik et al. | 441/5 |
| 5,676,083 | A * | 10/1997 | Korsgaard | 114/230.1 |
| 6,736,082 | B2 * | 5/2004 | Breivik et al. | 114/230.1 |
| 7,614,927 | B2 * | 11/2009 | Olsen et al. | 441/5 |
| 2004/0261683 | A1 | 12/2004 | Lindblade et al. | |

FOREIGN PATENT DOCUMENTS

| | | |
|---|---|---|
| GB | 2 387 188 | 10/2003 |
| WO | WO 93/11035 | 6/1993 |
| WO | WO 93/24731 | 12/1993 |
| WO | WO 93/24733 | 12/1993 |
| WO | WO 98/36964 | 8/1998 |
| WO | WO 99/30963 | 6/1999 |
| WO | WO 9949177 | 9/1999 |
| WO | WO 02/092423 A1 | 11/2002 |
| WO | WO 2004/094222 A2 | 11/2004 |

* cited by examiner

*Primary Examiner* — Lars A Olson
(74) *Attorney, Agent, or Firm* — Merchant & Gould P.C.

(57) ABSTRACT

The present invention relates to a connection system and a method for connecting and disconnecting a floating unit to and from a buoy which is connected to a subsea installation, where the buoy comprises a first connection device for connecting pipes and/or lines for transfer of fluid, control signals and/or electric power between the buoy and the floating unit. The connection system further comprises a support structure which is laterally movable relative to the floating unit and a swivel stack arrangement movably mounted on the support structure. The swivel stack arrangement comprises a second connection device for connecting to the first connection device in the buoy; shut-off devices for opening and closing at least one of the pipes and/or lines in the first and second connection devices by connecting and disconnecting the buoy; and a turret bearing for rotating the buoy relative to the floating unit.

12 Claims, 7 Drawing Sheets

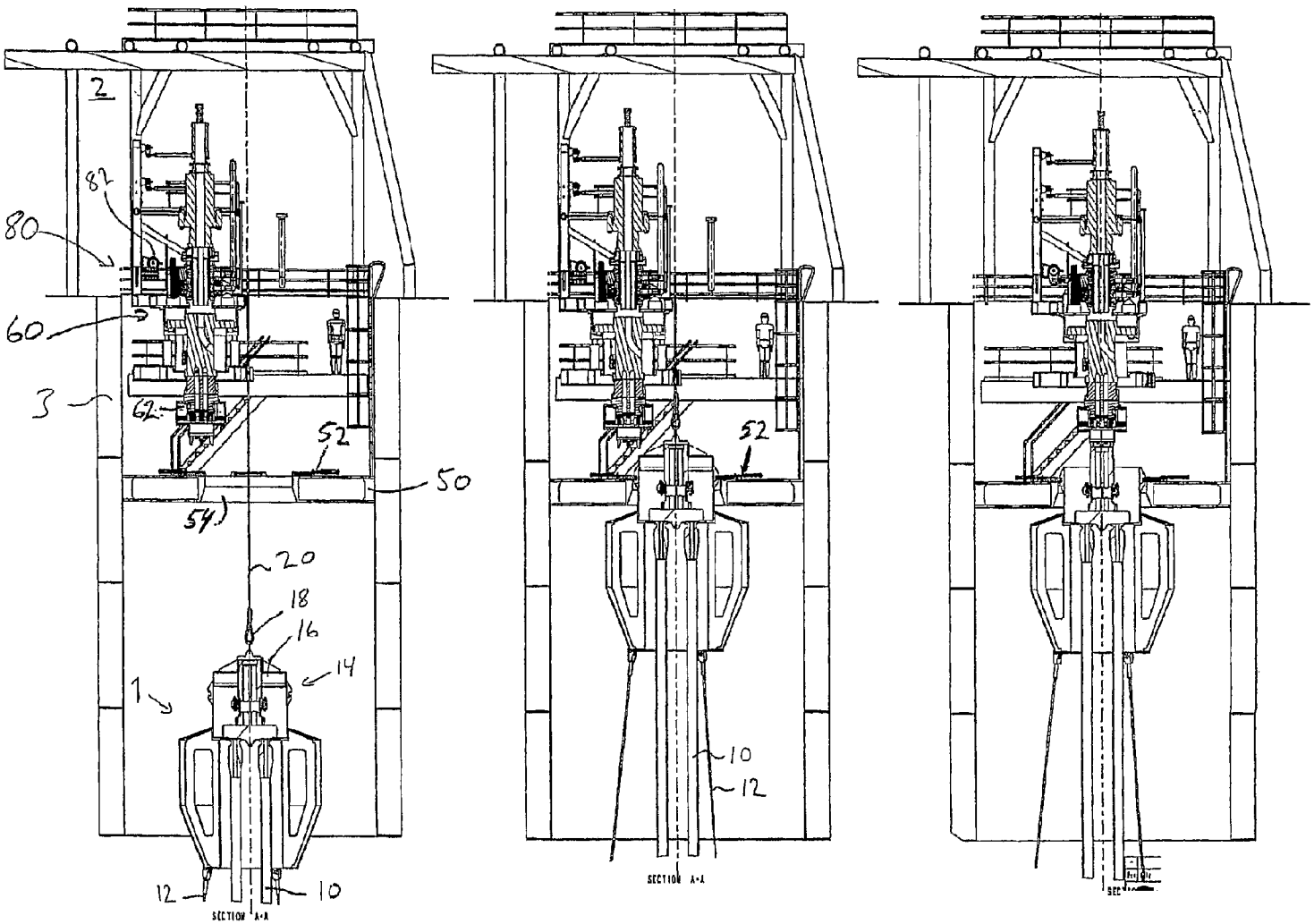
Fig. 1 a-c

CONNECTION SYSTEM AND METHOD FOR CONNECTING AND DISCONNECTING A FLOATING UNIT TO AND FROM A BUOY WHICH IS CONNECTED TO A SUBSEA INSTALLATION

This application is a National Stage Application of PCT/NO2007/000115, filed 23 Mar. 2007, which claims benefit of Serial No. 20061335, filed 23 Mar. 2006 in Norway and which application is incorporated herein by reference. To the extent appropriate, a claim of priority is made to each of the above disclosed applications.

TECHNICAL FIELD

The present invention relates to a method and a system for connecting a floating unit to a buoy in a subsea system.

THE PRIOR ART

In the field of offshore oil and gas production, the use is known of a vessel with (and without) dynamic positioning (DP). For example, wells are located on the seabed, and pipe connections for oil and/or gas, umbilical pipes, control cables, power supply cables etc. lead from the wells up to a buoy. Alternatively, the vessel may be used to transfer oil, gas and other media, which are naturally transported and stored in ships, from ship to ship, from shore to ship or from ship to shore. The buoy comprises buoyancy elements which enable it to float at a desired distance (for example 40-70 m) under the sea surface, and the buoy is further adapted to be pulled into and attached to the vessel.

The connection between the buoy and the vessel may be implemented by an ROV from the vessel being maneuvered to the buoy and attaching a wire thereto, whereupon the wire with the buoy is pulled up towards and into a connection system in the vessel, for example a dedicated turret/swivel compartment internally in the vessel, in an external turret solution, in a moon pool or towards a swivel/turret system on the side of the ship. In order to locate the buoy, it is usually equipped with a location transponder. Alternatively, the buoy may be pulled in towards the ship by means of a surface buoy which is connected to the submerged buoy.

The vessel may therefore be a production vessel, a storage vessel and/or an offloading vessel for oil and/or gas, or alternatively LNG, or other types of floating units, such as floating platforms etc.

With dynamic positioning the vessel is not normally anchored to the seabed, or it may be very lightly anchored; in both cases this means that the vessel has to use its engines to stay in the correct position. The vessel comprises propulsion units in the form of propellers and thrusters connected to a navigation system, which ensure that the vessel is kept in position at the buoy within given limits, even when influenced by wind and waves. However, bad weather may cause the vessel to be unable to stay in position, with the result that for reasons of safety a controlled shut-down of the transmission lines will occur, followed by disconnection of the vessel from the buoy, thereby enabling the vessel to move freely independently of the equipment under the surface. In given cases the buoy may also be equipped with anchoring devices to the seabed.

There are a number of requirements associated with this connection between the buoy and the vessel. First of all, the vessel must be able to rotate round the buoy, while the buoy must maintain its original orientation relative to the wells on the seabed in order to avoid damage to the pipe and cable connections between the installation and the buoy.

Furthermore, it is important for the connection, and particularly the disconnection to occur in a rapid and controlled manner in the event of sudden weather changes. It is also important for the relevant valves and pipes in the connection system and in the buoy to be emptied of hydrocarbon compounds before disconnection, in order to avoid polluting the water.

Another object of the invention is that the connection system can be employed with as many types of vessel as possible and therefore that the connection system is also flexible in relation to where it is mounted on the vessel. It is also an object that the vessel should require as little conversion as possible in order to be able to employ the connection system.

SUMMARY OF THE INVENTION

The present invention relates to a connection system for connecting and disconnecting a floating unit to and from a buoy which is connected to a subsea installation, where the buoy comprises a first connection device for connecting pipes and/or lines for transfer of fluid, control signals and/or electric power between the buoy and the floating unit;

where the connection system further comprises:

- a support structure which is laterally movable relative to the floating unit;
- a swivel stack arrangement movably mounted on the support structure, where the swivel stack arrangement comprises
  - a second connection device for connecting to the first connection device on the buoy;
  - shut-off devices for opening and closing at least one of the pipes and/or lines in the first and second connection device when connecting and disconnecting the buoy; and
  - a turret bearing for rotating the buoy relative to the floating unit.

The present invention also relates to a method for connecting a floating unit to a buoy which is connected to a subsea installation, for connecting pipes and/or lines for transfer of fluid, control signals and/or electric power between the buoy and the floating unit, characterised in that the method comprises the following stages:

- pulling the buoy into an opening in the floating unit;
- temporary locking of the buoy to the vessel;
- lateral movement of a support structure with a swivel stack arrangement, thereby placing it centrally over the buoy;
- connecting a second connection device in the swivel stack arrangement with a first connection device on the buoy;
- disconnecting the temporary locking arrangement;
- opening the shut-off devices in the buoy and the swivel stack arrangement, in order to start the transfer between the buoy and the floating unit.

When disconnecting the buoy from the floating unit the method further comprises the following stages:

- closing shut-off devices in the buoy and the swivel stack arrangement;
- draining the pipes between the shut-off devices by means of a drainage system;
- connecting the temporary locking arrangement;
- disconnecting the first and the second locking devices from each other;
- disconnecting the temporary locking arrangement in order thereby to uncouple the buoy from the floating unit.

Further preferred embodiments will become apparent from the dependent patent claims.

DETAILED DESCRIPTION

A preferred embodiment of the present invention will now be described in detail with reference to the attached drawings:

FIGS. 1*a-e* illustrate the different stages in the connection of the buoy to the vessel;

FIG. 1*f* illustrates an enlargement of parts in FIG. 1*e;*

FIG. 2 is a sectioned perspective view of the buoy, the swivel stack arrangement and parts of the vessel;

FIGS. 3*a* and 3*b* illustrate a rapid disconnection of the buoy from the vessel;

Figures 1, 12:
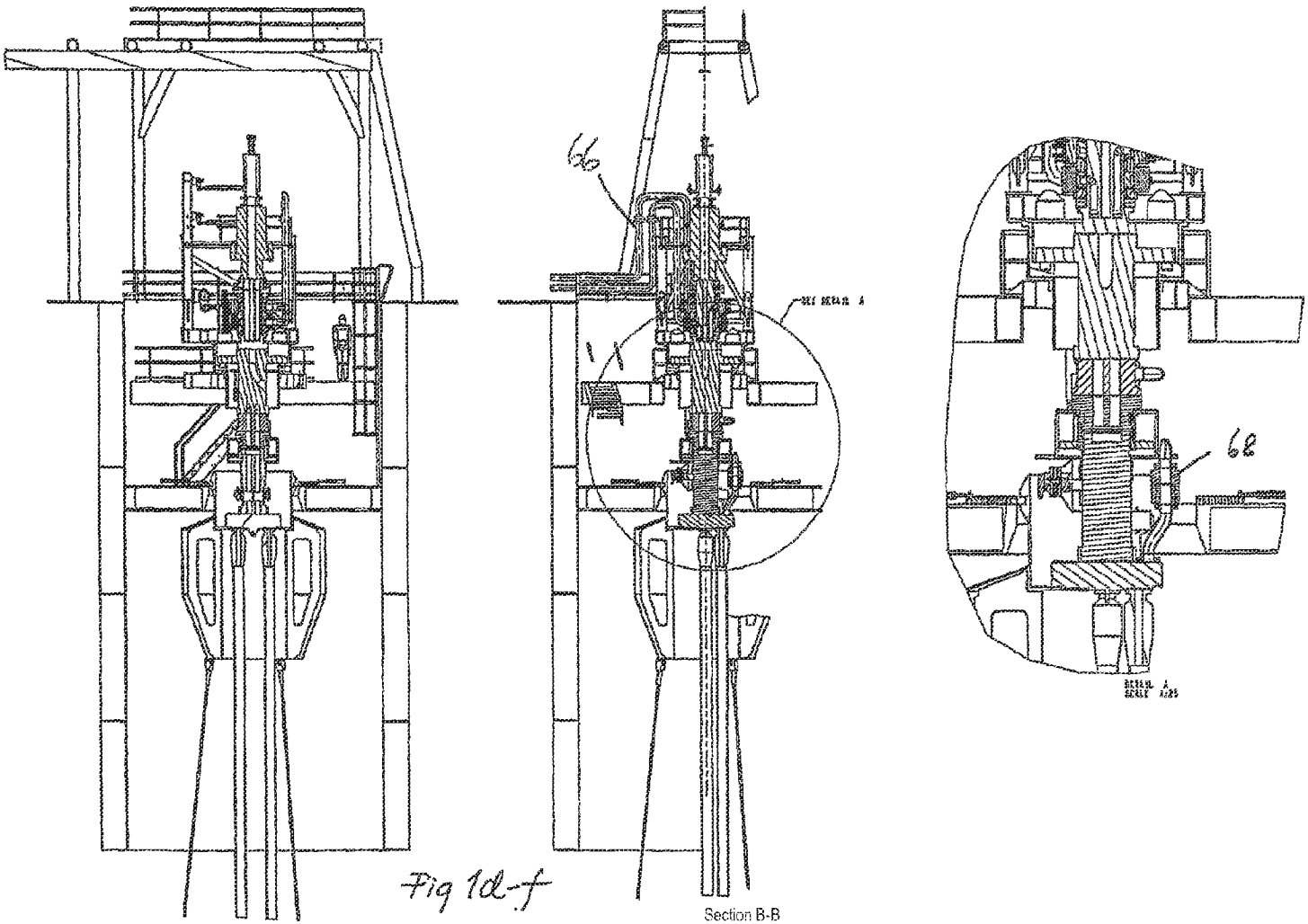
Figure 2:
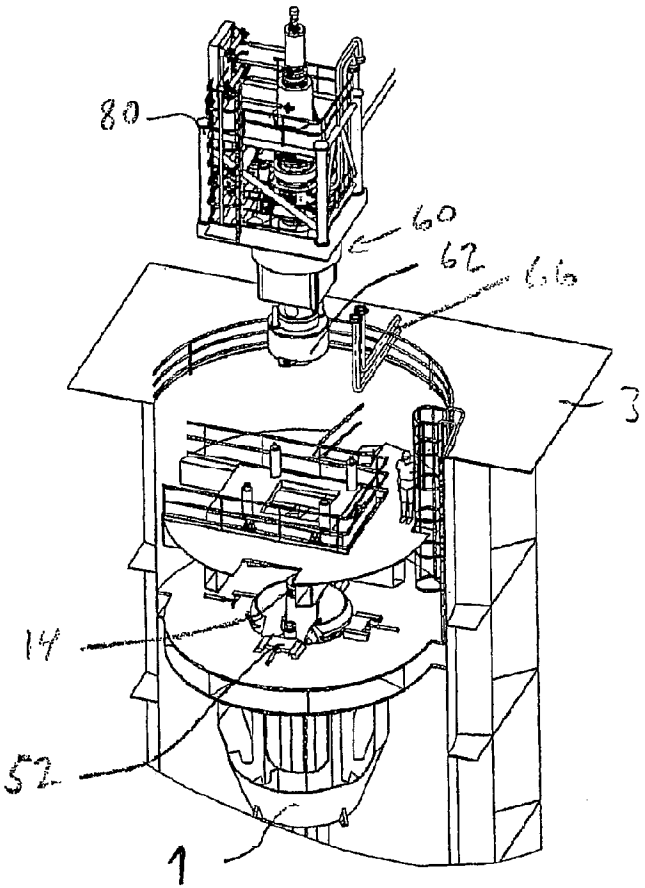
Figure 3B:
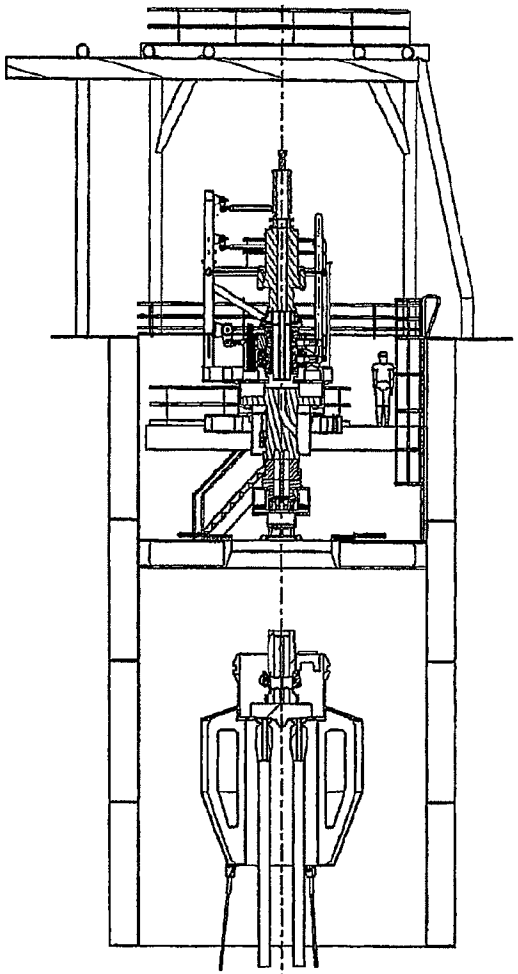
Figure 3A:
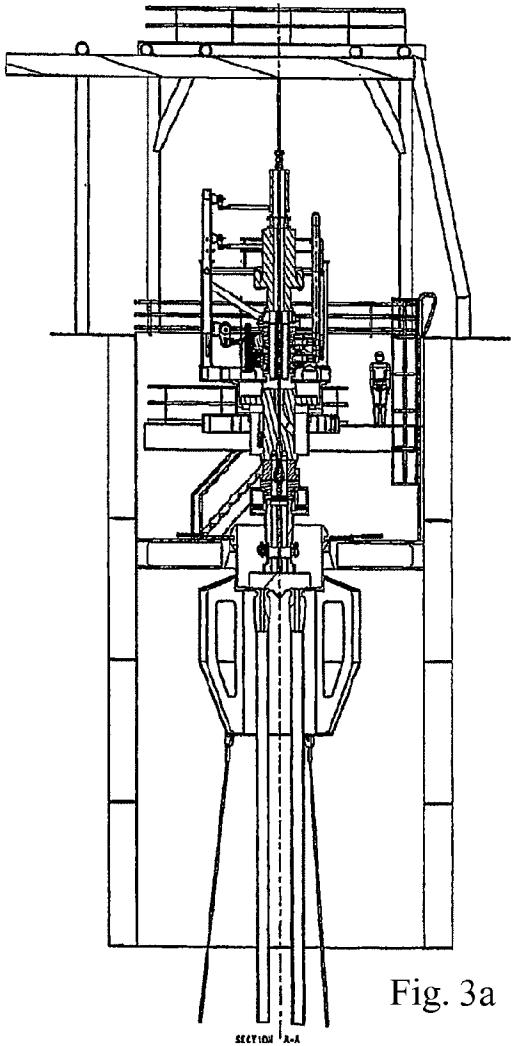

Referring to FIG. 1, a buoy 1 is shown in the process of being pulled into a turret/swivel compartment 2 on a vessel 3. The vessel 3 is preferably of the type mentioned in the introduction above, and has propulsion units in the form of propellers and thrusters connected to a navigation system which ensures that the vessel stays in position at the buoy within given limits. The vessel will preferably rotate with wind and wave direction in order to facilitate navigation.

Figure 5:
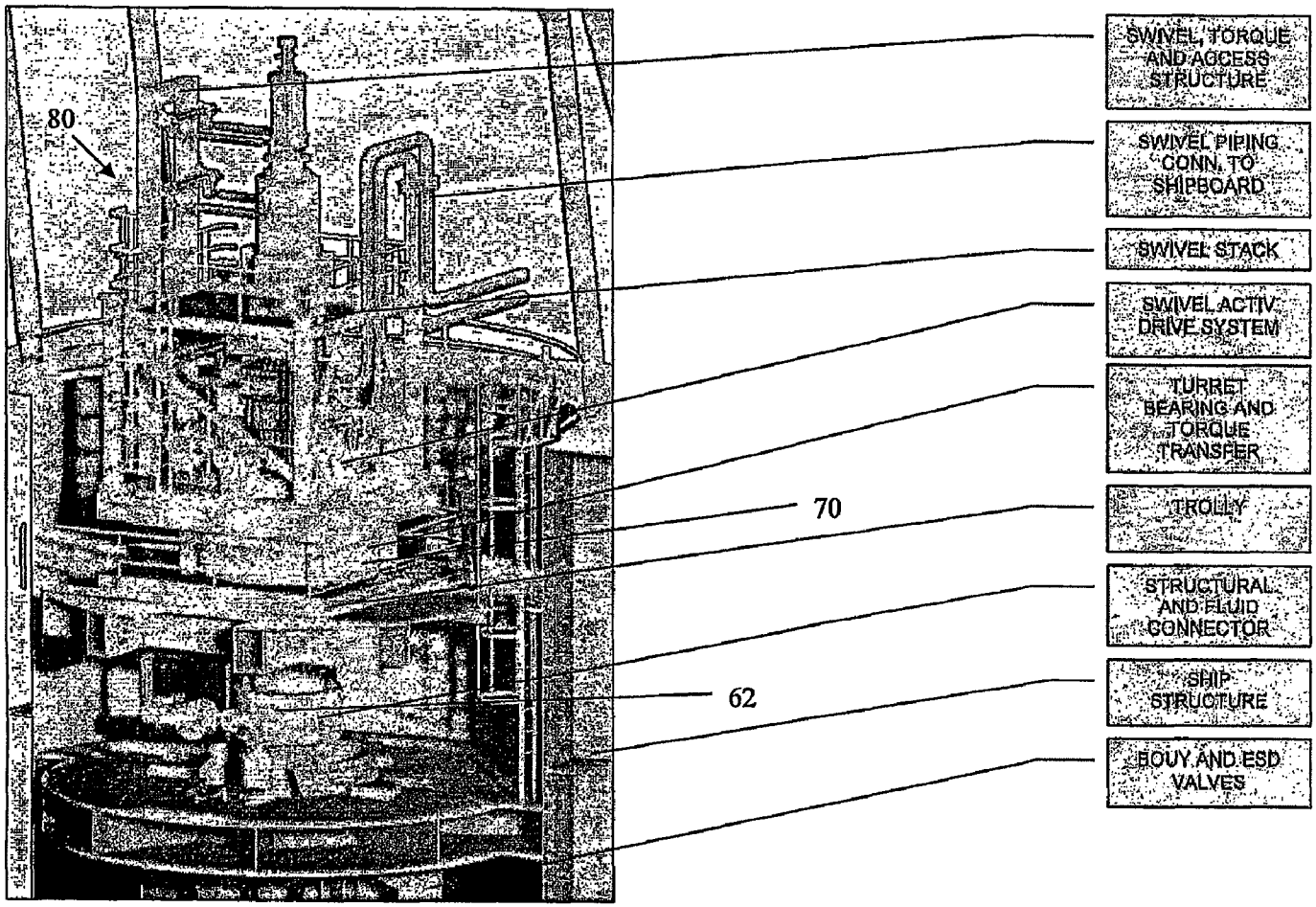
FIG. 5 is a perspective view of the swivel stack arrangement, where the turret bearing can be seen.
Figure 6:
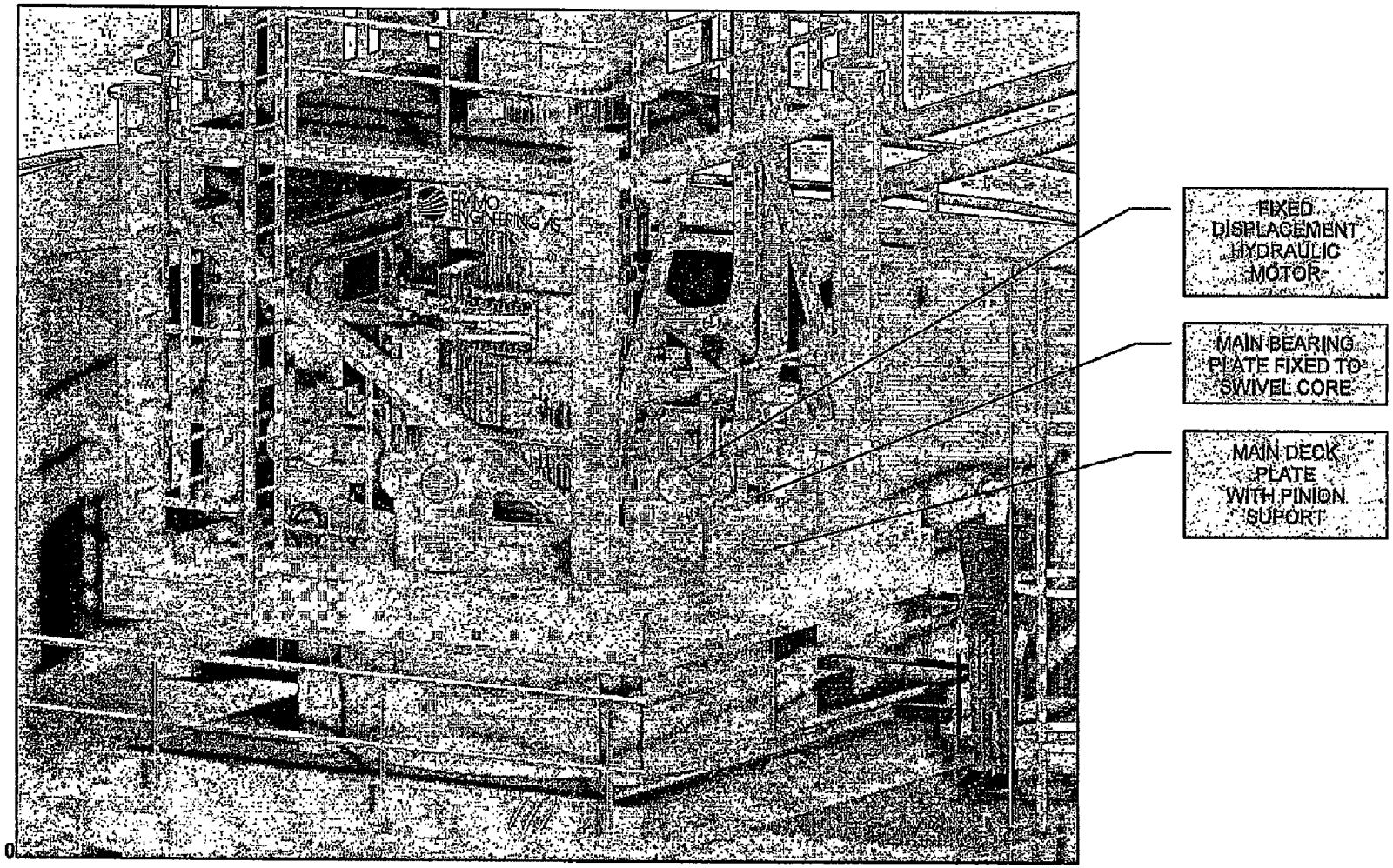
FIG. 6 illustrates details of the turret bearing.

The buoy must maintain its orientation relative to the seabed in order to avoid damage to the buoy or pipe connections and cables coupled thereto. The connection system according to the invention therefore comprises a turret bearing 70 (FIGS. 5 and 6) integrated in a swivel stack arrangement 60. The turret bearing 70 is preferably hydraulically driven and provides controlled orientation of the buoy relative to the vessel.

A swivel stack arrangement 60 and its function are further described in Norwegian Patent 306416. This publication is hereby incorporated in its entirety as reference.

The connection system according to the invention is preferably connected to the vessel's navigation system and provides control of the buoy and the vessel relative to each other and relative to the seabed, although it should be noted that the vessel does not need to have a dynamic positioning system in order for the present invention to work.

Referring now to FIG. 1*a*, the buoy 1 comprises one or more pipe connections 10 for oil, gas or other fluids from a subsea installation in addition to, for example, umbilicals, control cables and power supply cables (not shown in FIGS. 1*a-c*). Each pipe connection has an actuator-controlled isolation valve integrated as a part of the buoy. The buoy may further comprise mooring wires 12 for attaching the buoy to the seabed. The buoy contains buoyancy elements which keep the buoy afloat at a distance of approximately 40-70 m under the surface of the sea.

In the centre of the upper part of the buoy 1 there is mounted a first connection device 14, which in the preferred embodiment is a multichannel connection device adapted for connecting pipes and possibly also cables to a second connection device in the vessel, which will be described in detail below.

The buoy further comprises a protective cover 16 with a lift eye 18, adapted to permit an ROV to attach a pull-in wire 20 from the vessel to the lift eye 18. The buoy also comprises a location means (not shown), for example an acoustic transponder, for locating the buoy and for orientation of the buoy relative to the installation on the seabed. In an alternative solution the buoy is connected to a surface buoy, which the vessel employs for locating and pulling up the buoy 1.

In this embodiment the turret/swivel compartment 2 is provided as a separate compartment internally in the vessel (indicated by the numeral 3). In the floor 50 in this compartment 2 is mounted a temporary locking arrangement 52 with an opening 54 for the buoy 1. It can be seen from the figures that the opening 54 and the locking arrangement 52 are adapted to fit the shape of the buoy 1.

Over the opening 54 is mounted a swivel stack arrangement 60 attached to the vessel by means of a support structure 80. At the bottom the swivel stack arrangement 60 contains a second connection device 62, adapted to be connected to the first connection device 14. The second connection device 62 is also a multichannel connection, and provides both locking of the swivel stack arrangement 60 to the buoy 1 as well as permitting fluid transfer between the buoy 1 and the vessel via the swivel stack arrangement 60.

The connection devices 14, 62 typically comprise two pipe connections with a diameter of 5-6" together with electrical and hydraulic control cables. It is preferred that the connection devices are capable of being disconnected from each other with a certain tensile stress and with relatively large angular deviation, which may be necessary to enable the disconnection to be performed rapidly in bad weather conditions.

The swivel stack arrangement 60 further comprises actuator-controlled isolation valves in each pipe connection. In this way the pipe connections can be closed both by means of the isolation valves in the buoy and by the isolation valves in the swivel stack arrangement, which is necessary when disconnecting the buoy. The isolation valves are further described below with reference to FIG. 4.

The pipe connections in the swivel stack arrangement 60 lead to a processing unit, storage tanks or the like in the vessel by means of other pipe connections 66, as illustrated in FIG. 1*e*.

As mentioned above, the swivel stack arrangement 60 comprises a turret bearing 70, which provides controlled rotation of the second connection device 62 and thereby rotation of the buoy 1. The turret bearing 70 is preferably driven by hydraulic motors (see FIGS. 5 and 6).

The support structure 80 supports the swivel stack arrangement 60 relative to the vessel. The support structure comprises a plurality of impellers 82 which permit the support structure 80 with the swivel stack arrangement 60 to be laterally movable along rails in the compartment 2. This means that the swivel stack arrangement 60 can be pushed away from the buoy when required for conducting operations thereon. The support structure 80 may of course be locked to the vessel when the desired positions have been achieved, thereby preventing undesired movement from occurring.

The support structure 80 also comprises a lifting device for raising and lowering the swivel stack arrangement relative to the buoy 1. This will be apparent from the description below.

When the buoy is attached to the swivel stack arrangement 60, the support structure 80 the turret bearing 70 and the second connection device 62 transfer torque forces from the buoy to the vessel.

Figure 4:
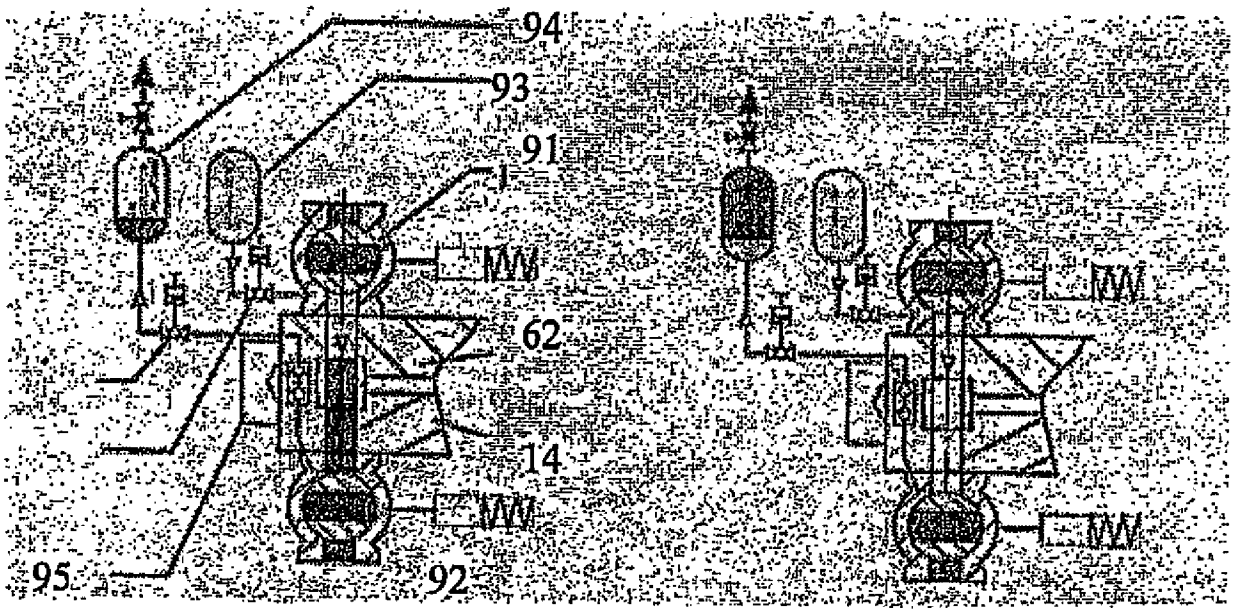
FIG. 4 illustrates the drainage system for removing fluid from the connection device before disconnection.

The connection system preferably comprises a drainage system for removal of fluid in the system before disconnecting the buoy. This is an operation which is conducted after the isolation valves in the swivel stack arrangement and the buoy respectively are closed. The drainage system 90 is illustrated in FIG. 4. Shown here are the hydraulic isolation valve 91 in the swivel stack arrangement and the hydraulic isolation valve 92 in the buoy, each of which closes off the fluid connection between the buoy and the vessel. The reference numeral 93 designates a nitrogen tank connected to the fluid connection for injecting nitrogen into the fluid connection through an injection channel. The injection valve can be controlled by means of a valve.

Reference numeral 94 designates a waste accumulator connected to the fluid connection for collecting fluid and nitrogen pressed out of the fluid connection through an exhaust channel due to the nitrogen injection. The channel between the fluid connection and the accumulator may be closed by means of a valve.

The use of the connection system according to the invention will now be described. As mentioned above, an ROV is employed for attaching a pull-in wire 20 to the lift eye 18. A winch pulls the pull-in wire 20 and the buoy is guided into the turret/swivel compartment 2 (see FIG. 1*a*) via the opening 52.

The temporary locking arrangement 54 locks the buoy to the vessel, thereby enabling the pull-in wire 20 to be removed. The cover 16 with the lift eye 18 is then removed (see FIG. 1*b*).

The support structure 80 with the swivel stack arrangement 60 are then pushed sideways with the result that the first and second connection devices in the buoy and the swivel stack arrangement respectively are centrally located above each other (see FIG. 1*c*). The second connection device in the swivel stack arrangement is also rotated by means of the turret bearing 70, thereby obtaining the correct orientation relative to the first connection device 14 in the buoy.

After the correct orientation has been achieved, and everything generally is ready for connection, the swivel stack arrangement 60 is lowered towards the buoy. The first connection device 14 in the buoy is connected to the second connection device 62 in the swivel stack arrangement and the connection is compression tested. Control cables, power supply cables and hydraulic connections will then be connected between the buoy and the swivel stack arrangement (see FIGS. 1*d-f*).

It should be noted that pipe connections 68 may also be connected on the outside of the connection devices 14, 62, as illustrated in FIG. 1*f*. These pipe connections may either have their own hydraulic connection devices, or they may be of a simpler design.

The temporary locking arrangement is now uncoupled, thereby causing the buoy to be suspended in the swivel stack arrangement via the connection devices 14, 62.

The connection system according to the invention is now ready for use, and the valves can be opened for transfer of fluid, any control signals and electric power or the like.

Before disconnection is carried out, the pipe connections will always be drained of fluid by means of the drainage system 90, as described above.

During a normal disconnection of the buoy from the connection system, the above stages will usually be carried out in reverse order.

During a rapid disconnection the cover 16 with the lift eye 18 will not be mounted on the buoy before it is disconnected. Instead, the buoy will be dropped into the water after all the equipment is disconnected, and the cover will be mounted under water by means of an ROV.

It should be noted that forces and torque in the present invention are transferred through the connection devices via the turret bearing in the swivel stack arrangement to the vessel.

In the prior art the turret bearing is integrated as a part of the opening 54 in the vessel, which requires a greater modification of the vessel than in the present invention, where the turret bearing is integrated in the actual swivel stack arrangement. The present invention therefore achieves greater flexibility with regard to the kind of vessels or other floating units on which it can be mounted, and the mounting operation will also be less expensive.

The invention claimed is:

1. A connection system on a dynamically positioned floating unit for connecting and disconnecting the dynamically positioned floating unit to and from a buoy which is connected to a subsea installation, where the buoy comprises a first connection device for connecting pipes and/or lines for transfer of fluid, control signals and/or electric power between the buoy and the dynamically positioned floating unit; where the connection system for a dynamically positioned floating unit comprises:

a support structure which is laterally movable relative to the dynamically positioned floating unit;

a swivel stack arrangement movably mounted on the support structure, where the swivel stack arrangement comprises a second connection device for connecting to the first connection device on the buoy;

shut-off devices for opening and closing at least one of the pipes and/or lines in the first and second connection device when connecting and disconnecting the buoy; and a turret bearing for controlled orientation of the buoy relative to the dynamically positioned floating unit.

2. A connection system on a dynamically positioned floating unit according to claim 1, wherein it further comprises a drainage system for removing fluid in the connection system before disconnecting the buoy.

3. A connection system on a dynamically positioned floating unit according to claim 1, wherein it further comprises a temporary locking arrangement for temporary locking of the buoy to a receiving opening in the dynamically positioned floating unit.

4. A connection system on a dynamically positioned floating unit according to claim 1, wherein the pipes are pipes for oil and/or gas or other fluids that have to be transferred from a dynamically positioned floating unit to shore, from shore to a dynamically positioned floating unit or between dynamically positioned floating units.

5. A connection system on a dynamically positioned floating unit according to claim 1, wherein the lines are signal lines for transmitting electrical or other types of signals, power transmission lines for transmitting electric, hydraulic/chemical or other types of power.

6. A connection system on a dynamically positioned floating unit according to claim 1, wherein the swivel stack arrangement can be raised and lowered relative to the support structure.

7. A connection system on a dynamically positioned floating unit according to claim 1, wherein the first and second connection devices are multichannel connection devices.

8. A connection system on a dynamically positioned floating unit according to claim 1, wherein the floating unit is positioned beside the buoy by means of a dynamic positioning system.

9. A connection system on a dynamically positioned floating unit according to claim 8, wherein positioning data from the positioning system are employed in order to maintain the rotational position of the buoy relative to the subsea installation.

10. A connection system on a dynamically positioned floating unit according to claim 1, wherein it comprises a winch with a wire adapted for attachment to a lift eye in a protective cover on the buoy, for pulling the buoy in towards the dynamically positioned floating unit.

11. A method for connecting a dynamically positioned floating unit to a buoy which is connected to a subsea installation, for connecting pipes and/or lines for transfer of fluid, control signals and/or electric power between the buoy and the dynamically positioned floating unit, wherein the method comprises the following stages:

pulling the buoy into an opening in the dynamically positioned floating unit;

temporary locking of the buoy to the dynamically positioned floating unit;

laterally moving a support structure with a swivel stack arrangement, thereby placing it centrally over the buoy;

connecting a second connection device in the swivel stack arrangement with a first connection device in the buoy;

disconnecting the temporary locking arrangement;

opening shut-off devices in the buoy and the swivel stack arrangement, in order to start the transfer between the buoy and the dynamically positioned floating unit; and controlling the orientation of the buoy relative to the dynamically positioned floating unit.

12. A method according to patent claim 11, wherein disconnection of the buoy from the dynamically positioned floating unit is performed by the following stages:

closing shut-off devices in the buoy and the swivel stack arrangement;

draining the pipes between the shut-off devices by means of a drainage system;

connecting the temporary locking arrangement;

disconnecting the first and the second locking devices from each other;

disconnecting the temporary locking arrangement in order thereby to uncouple the buoy from the dynamically positioned floating unit.

* * * * *